United States Patent [19]

Maran

[11] 4,093,123

[45] June 6, 1978

[54] AIRLESS SPRAYER AND PRESSURIZING SYSTEM

[75] Inventor: Victor J. Maran, Playa del Rey, Calif.

[73] Assignee: Dispenser Corporation, Milwaukee, Wis.

[21] Appl. No.: 638,763

[22] Filed: Dec. 8, 1975

Related U.S. Application Data

[63] Continuation-in-part of Ser. No. 567,307, Apr. 11, 1975, abandoned.

[51] Int. Cl.[2] ..... B05S 9/047

[52] U.S. Cl. ..... 239/322; 141/20; 222/402.24; 239/396; 251/DIG. 1

[58] Field of Search ..... 222/389, 402.24; 239/322, 333, 493, 494, 396; 141/3, 20; 137/231, 223; 251/DIG. 1

[56] References Cited

U.S. PATENT DOCUMENTS

| | | | |
|---|---|---|---|
| 912,691 | 2/1909 | Koenigkramer et al. | 239/396 |
| 1,158,904 | 11/1915 | Dunbar | 222/389 |
| 1,289,474 | 12/1918 | Keister | 137/231 |
| 2,044,696 | 6/1936 | Huss | 239/493 X |
| 2,149,681 | 3/1939 | Johnston | 137/231 |
| 2,154,255 | 4/1939 | Williams | 137/223 |
| 2,706,660 | 4/1955 | Johnson et al. | 222/402.24 X |
| 2,855,946 | 8/1958 | Mackal | 137/223 |
| 3,081,916 | 3/1963 | Rhodes et al. | 222/402.24 X |
| 3,181,737 | 5/1965 | Chaucer | 141/20 X |
| 3,321,110 | 5/1967 | Price | 222/389 |
| 3,592,244 | 7/1971 | Chamberlin | 141/3 X |
| 3,817,297 | 6/1974 | King | 141/20 |

FOREIGN PATENT DOCUMENTS

| | | | |
|---|---|---|---|
| 534,495 | 1/1955 | Belgium | 239/396 |

*Primary Examiner*—Stanley H. Tollberg
*Assistant Examiner*—Francis J. Bartuska
*Attorney, Agent, or Firm*—Michael, Best & Friedrich

[57] ABSTRACT

An airless sprayer having the capability of replacing most if not all of the so-called aerosol sprayers with improved performance, reduced cost and elimination of potential damage to the environment from an aerosol propellant. The unit is refillable by the user at any time suiting his convenience. The liquid to be sprayed is contained in a first chamber above an internal free-floating piston powered by air pressure in a second chamber below the piston. The system includes a unique compressor unit for automatically pumping air at operating pressure into the lower chamber.

16 Claims, 13 Drawing Figures

Fig 4
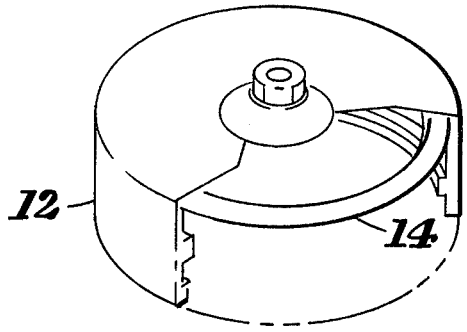
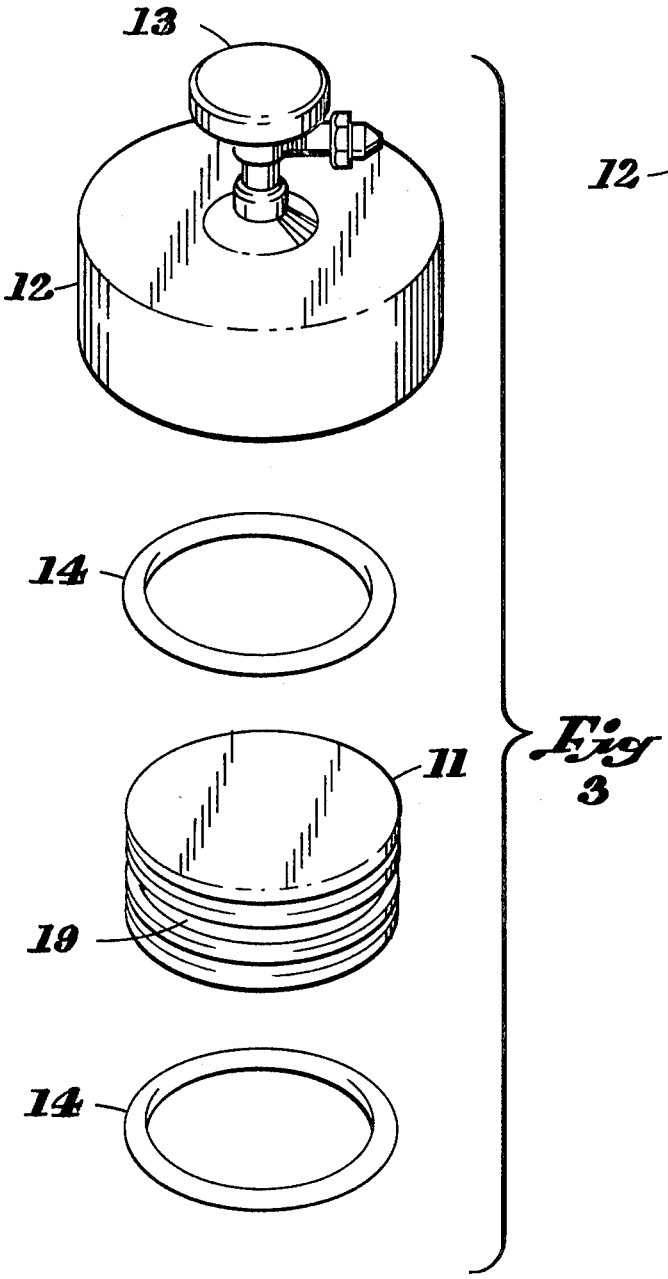
Fig 3
Fig 2
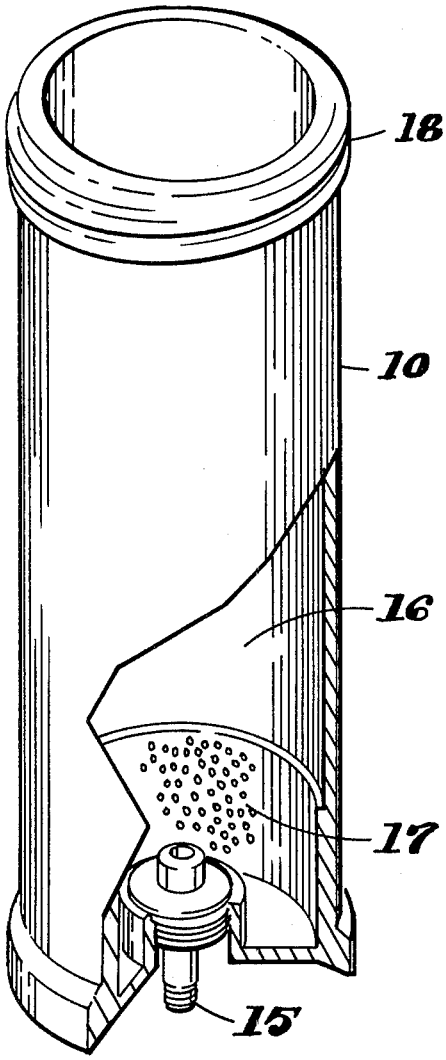

AIRLESS SPRAYER AND PRESSURIZING SYSTEM

CROSS-REFERENCE TO RELATED APPLICATION

This application is a continuation-in-part of United States application Ser. No. 567,307 filed Apr. 11, 1975 now abandoned entitled Piston Power Airless Spray Systems, standing in the name of Victor J. Maran.

BACKGROUND OF THE INVENTION

1. Field of the Invention

This invention relates to liquid spraying devices and, more particularly, to such devices capable of operating as self-sustained units.

2. Description of the Prior Art

With the advent of so-called aerosol sprayers, it has become customary for individual consumers to utilize a variety of liquids prepackaged in such units for spraying. Such units are commonly in sizes approximating 6, 11 or 14 ounces net weight of a liquid to be sprayed and a suitable propellant such as Freon. The contents are under low pressure which is supposed to be maintained at an effective level by the propellant throughout the useful life of the unit. A readily operable finger valve is used to release the contents. A wide variety of materials are marketed in aerosol spray containers, including paints, household cleaners, hair sprays and other beauty aids, fire extinguishers, insecticides, lubricants and degreasers, to name a few. The units are not refillable, but are designed to be discarded when used up.

Numerous problems exist with respect to these common aerosol sprayers. Valves frequently malfunction and may clog so that the entire contents of the container cannot be used or they may stick in the open position so that the contents are released when they are not needed to be used. Loss of propellant may occur so that the contents cannot be released. They are hazardous in that they may explode if exposed to heat in excess of 120° F. and may cause serious damage if punctured. Some scientists contend that the ozone layer protecting the earth from bombardment by cosmic rays and other radiation may be damaged or destroyed by the accumulation of aerosol propellants discharged into the atmosphere. Other deleterious effects may result from the release of aerosol propellants in a confined spaced occupied by humans or simply by the inhalation of the propellant gas into the lungs during use.

In addition, considerable economic waste is involved in the system of aerosol use. The containers are not recyclable insofar as is known and they frequently are discarded by careless users in ways that litter the landscape. The metals and other materials used in the containers are not recycled. According to information at hand, more than half of the listed net weight contents of an aerosol container comprises the propellant and less than half is made up by the material which is to be sprayed. Also, more than half of the cost of the contents is due to the cost of the propellant contained therein; this is without regard to the the cost of the container involved. Thus, the cost of the actual material used by the purchaser of an aerosol sprayer is a relatively small fraction of the purchase price of the aerosol can and contents.

In view of the numerous drawbacks involved in the use of aerosol spray containers, and particularly as a result of the present invention concern upon the effects of the use of such devices on our environment, efforts are being made to market many of the materials formerly packaged in aerosols in other forms of containers with various types of applicators. A common approach has been to provide the liquid in a container with a small finger-operated pump contained therein. However, these are not universally effective and they certainly lack the convenience of the aerosol spray device. There is obviously a need for a device which can spray with the effectiveness of an aerosol sprayer (when it is working properly) in a safe and harmless manner without the various drawbacks of the aerosol sprayer. Such a device should have a self-contained propellant with the capability of emitting a spray comparable to that available from the aerosol. Preferably, the device should be readily manufacturable from low cost materials and should be reliable in operation. It should be refillable with bulk materials available at low cost. It should be easily pressurizable with a harmless and readily available propellant.

The present invention meets these requirements.

SUMMARY OF THE INVENTION

In brief, arrangements in accordance with the present invention involve a container in the form of a cylindrical cannister or can not dissimilar in configuration from conventional aerosol devices. At the top is located a valve mechanism readily operable by finger pressure to release the liquid contents from the container. An outlet nozzle is provided to develop and control the spray form of the released liquid.

The interior of the container is divided into a first, upper chamber for the liquid and a second, lower chamber for the propellant by a free-floating piston which is movable along the interior of the container to maintain the upper chamber pressurized from the pressure of the propellant in the lower chamber as the liquid is expelled. Preferably the propellant is air. The container is provided with a valve arrangement near the base for admitting and retaining air under pressure into the lower chamber. In accordance with an aspect of the invention, an associated air compressor is provided specifically designed for pressurizing the lower chamber with air after the upper chamber has been filled with liquid and in preparation for use of the spray device. Once charged with compressed air to a predetermined pressure, the device may be used without further charging until all of the liquid has been expelled. Contrary to the limitation imposed upon an aerosol spray device, which must be used in an upright attitude, the sprayer of the present invention can be operated on its side, upside down, or in any other attitude. The terms "upper" and "lower" as used herein apply to the container in its upright attitude.

The upper end of the cylindrical container is closed by a removable cap on which the release valve with nozzle is mounted. O-ring seals are used throughout wherever a sealing relationship is needed between slidable or removable parts. When the container is to be refilled, the lower air valve may be depressed so as to release the pressure in the lower chamber. The cover is then unscrewed from the container and the piston is moved to its bottom position in the container, determined by a piston ledge or lip near the lower end of the container. The upper chamber is now filled with the material which is to be sprayed. An added advantage of embodiments of the present invention is that, with suitable cleaning between refills, the same sprayer unit may be used with a succession of different liquids for spraying.

After the upper chamber is filled, the cover is screwed back in place and the lower chamber is pressurized by air to a predetermined pressure, preferably about 150–200 pounds per square inch, through the lower air valve. In accordance with an aspect of the invention, this may be most readily accomplished by affixing the container at its lower air valve portion to the associated compressor of my invention and setting the compressor to run for a predetermined period of time which will automatically fill the chamber to the desired pressure. After this is done, the cannister air valve is simply released from attachment to the compressor and the sprayer is ready for use.

The compressor is a unique positive displacement unit having a piston reciprocally operable in a cylinder without a cylinder head. The open cylinder is closed by the attachment of the lower air valve assembly of the sprayer in a manner which seals the two together. An intake air valve associated with the piston compresses air in the cylinder which is driven into the lower chamber of the sprayer through the lower air valve thereof which at this point operates as the exhaust valve of the compressor cylinder.

In accordance with a particular aspect of the invention, a particular deflector element is incorporated within the nozzle head of the device. Without such a deflector, I have found that the nozzle simply shoots a needle jet of liquid over a considerable distance, perhaps as much as 50 feet, without the jet expanding into a spray. This may be desirable in certain situations, as for example where one is attempting to apply an insecticide to the upper branches of a tree, or in fighting a fire. With the use of a deflector, the emission can be controlled to cover varying extents of spray for different liquids, depending on the viscosity and other properties of the liquid. The deflector is a single element with apertures introducing a whirling effect of the liquid as it passes therethrough. It is considered that the centrifugal force developed by the whirling effect induced in the liquid serves to develop the spray as the liquid jet leaves the nozzle.

The nozzle of the present invention is readily removable for cleaning if desired. Cleaning is sometimes essential, as in the spraying of paints and other liquids which might have a tendency to dry and clog the nozzle passages. Aerosol type paint spray nozzles may sometimes be cleaned after use by operating the sprayer for a few seconds in an upside down attitude. I have provided an adapter which uses a blast of air from the lower chamber of the sprayer of the present invention to clear the nozzle of all residue of any liquid which has been sprayed. A solvent or other cleaning agent may be used in conjunction therewith if desired.

BRIEF DESCRIPTION OF THE DRAWING

A better understanding of the present invention may be had from a consideration of the following detailed description taken in conjunction with the accompanying drawing, in which:

FIG. 2 is a perspective view, partially broken away, showing the container and lower inlet valve of a variation of the arrangement of FIG. 1;

FIG. 3 is an exploded view showing the piston, O-ring seals and cover with outlet valve and spray nozzle of the variation of FIG. 2;

FIG. 4 is a perspective view, partially broken away, of the cover and internal seal of the variation of FIG. 2;

DESCRIPTION OF THE PREFERRED EMBODIMENTS

Figure 1:
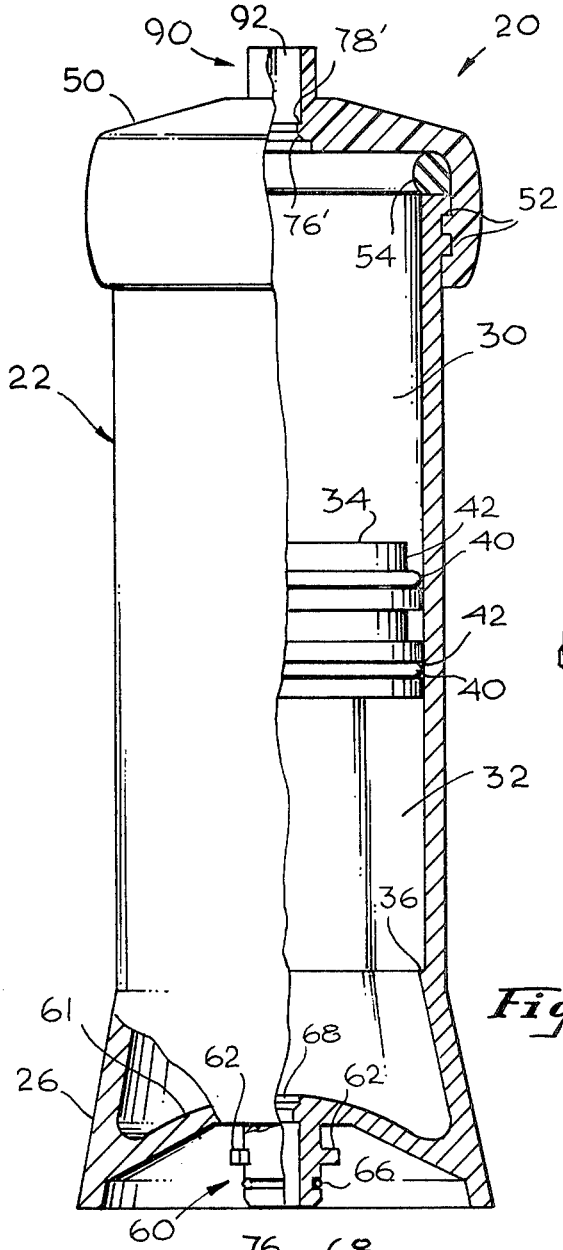
FIG. 1 is a side elevation, in partial section, of a sprayer in accordance with the present invention, less the outlet valve and nozzle.

Referring initially to FIGS. 2–4, there is shown therein a particular embodiment in accordance with the present invention comprising a cylindrical metal container 10 having a first liquid chamber 16 and a second air or power chamber 17. At the bottom of the container 10 and communicating with the power chamber 17 is a conventional pressure air valve 15. A free-floating piston 11, seen in the exploded view of FIG. 3, is positioned within the container 10 in preparation for filling and during use, and serves to divide the liquid chamber 16 from the power chamber 17. O-ring seals 14 are used with the piston 11 to effectively seal the lower chamber 17 against passage of the air or other propellant therein past the piston 11. A cover 12 (FIGS. 3 and 4) is arranged to be threadably mounted on top of the container 10 by means of mating threads such as 18 (FIG. 2). The cover 12 is removed from the container 10 to permit filling of the liquid chamber 16 or for cleaning or for any other purpose. An additional O-ring 14 is included inside the cover 12 for providing an effective seal between the cover 12 and the container 10. A release valve 13 is mounted on top of the cover 12 for releasing the liquid contents of the upper chamber 16 of the container 10 at the will of the user. The valve 13 is shown in FIG. 3 as including a press knob and nozzle for directing the spray from the container 10 when the valve 13 is pressed for release.

The piston 11 is shown in FIG. 3 as having three circumferential grooves, two for receiving the O-rings 14 and an intermediate lubrication groove 19 for receiving and holding a supply of a lubricant for the piston, such as oil or cream.

A second preferred embodiment of the present invention is depicted in the partial sectional view of FIG. 1, and further details of this embodiment are shown in FIGS. 5–9. Referring to FIG. 1, an airless sprayer or dispenser 20 in accordance with the invention is shown comprising a container 22 in the form of a cylindrical cannister having an upper or body portion 24 and a skirt or base portion 26. The body portion is hollow and defines a first, upper chamber 30 for a liquid to be dispensed and a second, lower chamber 32 for the compressed propellant. The two chambers 30, 32 are separated by a free-floating piston 34 which is freely movable between a piston ledge 36 encircling the interior of the body 24 and the upper end of the container 22, depending upon the pressure in the lower chamber 32 and the amount of liquid in the upper chamber 30. As the liquid is dispensed from the upper chamber 30, the piston 34 moves upwardly, contracting the volume of the upper chamber 30 and increasing the volume of the lower chamber 32 under the influence of the pressure of the propellant therein. The piston 34 includes a pair of upper and lower O-ring seals 40 mounted in grooves or recesses 42.

A cap or cover 50 is threadably and releasably mounted at the upper end of the container 22 by means of mating threads 52. An additional O-ring 54 is provided for sealing the cap 50 to the container 22.

At the bottom 61 of the container 22, centrally located within the skirt portion 26, is an intake valve 60. When the container 22 is made of plastic or the like, the body 63 of this valve 60 is preferably integrally molded with the container 22 as a part thereof. It includes a pair of protruding latching lugs or dogs 62, diametrically opposed to each other, and a recess 64 for an O-ring 66. The valve 60 also has a hollow bore 68 extending along the longitudinal axis of the container 22 for communicating between the interior lower chamber 32 and the exterior of the container 22.

Figure 5:
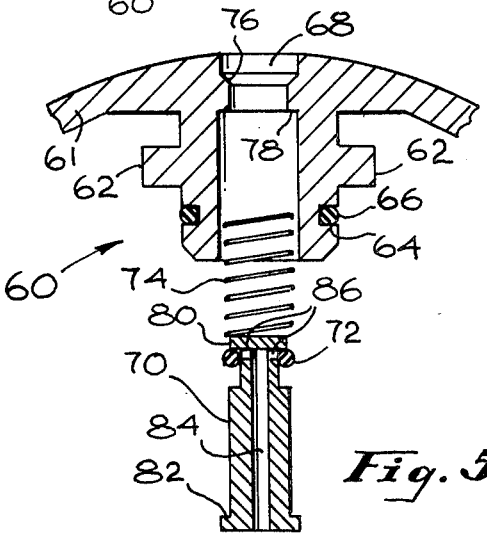
FIG. 5 is an exploded view in section showing the intake air valve assembly of the variation of FIG. 1 in expanded detail.

Further details of the intake valve 60 are shown in FIG. 5 which is an enlarged sectional exploded view of the valve 60. As indicated in FIG. 5, in addition to the elements already enumerated, the valve 60 includes an insert 70 having an O-ring seal 72 and a compression spring 74. The bore 68 of the valve 60 is shaped with a interiorly projecting slanted surface 76 and a shoulder 78. In assembly, the spring 74 is placed in the bore 68 from the underside to bear against the shoulder 78. Thereafter the insert 70 with the O-ring 72 removed is slipped into the bore 68 interiorly of the spring 74 and upward until the top 80 of the insert 70 projects above the bottom 61 of the container 22. The O-ring 72 is then slipped over the top 80 into the position shown and the insert 70 is released. Under the force of the compression spring 74 which bears between the shoulder 78 of the bore 68 and a corresponding shoulder 82 on the insert 70, the insert 70 is pushed downward until the O-ring 72 engages the slanted surface 76 in sealing relationship. It will be noted that the outside diameter of the O-ring 72 exceeds the inside diameter of the bore 68 at the projecting surface 76, thus retaining the insert 70 within the bore 68 against the force of the spring 74. Under compression, the O-ring seals the valve 60.

The insert 70 is hollow, having an axial bore 84 which extends to but not through the top member 80. The bore 84 at the upper end thereof communicates with a plurality (two are shown) of radial openings 86 under the O-ring 72. These openings are sealed as long as the insert 70 is maintained in its released position with the O-ring seal 72 bearing against the surface 76. In this position, the valve 60 prevents the release of air or other propellant from the interior of the container 22. Release of the air in the lower chamber 32 of the container 22 may be effected, however, by pushing upward on the insert 70 until the O-ring 72 is released from sealing engagement with the top 80 and openings 86, at which point it permits air to flow past the O-ring 72 through the openings 86 and out the bore 84. In similar fashion, air may be forced into the lower chamber 32 through the valve 60 by applying a source of compressed air to the lower end of the valve 60 in a manner to be described hereinafter, thus forcing the insert 70 upward to release the seal of the O-ring 72 over the openings 86.

Figure 6:
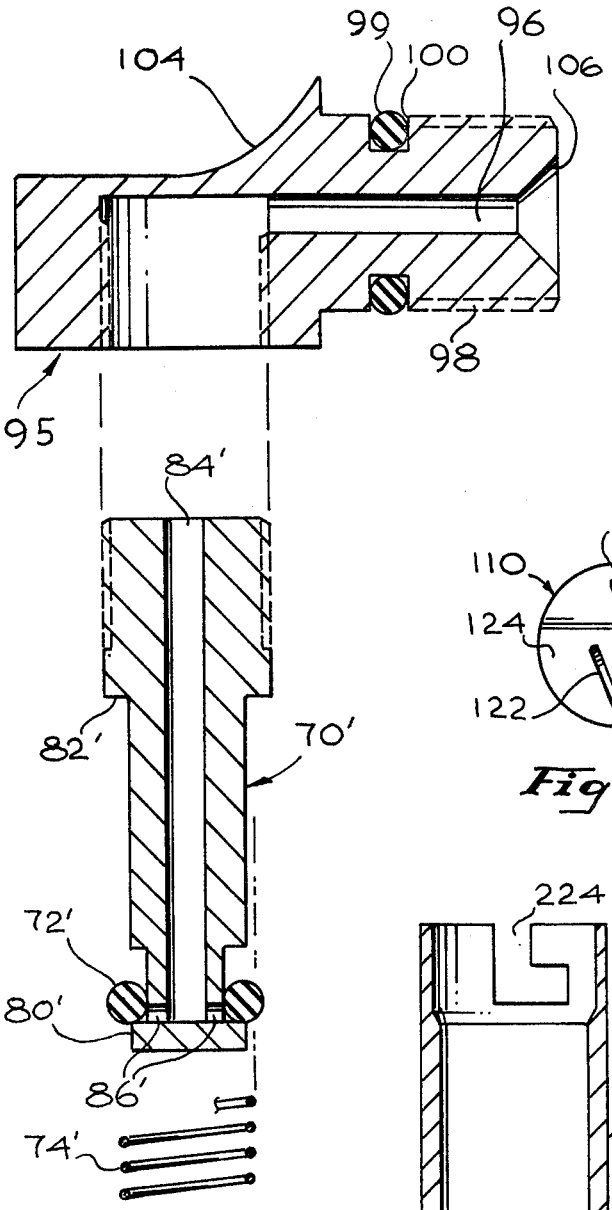
FIG. 6 is an exploded view showing the release valve and valve actuating mechanism of the variation of FIG. 1.

Referring to FIGS. 1 and 6, the cover 50 is provided with a similar structure forming a release valve 90. The valve 90 is formed as part of the cover 50 with a bore 92 having an interior structural configuration similar to that shown for the intake valve 60. The exploded view of FIG. 6 shows the remaining parts of the valve 90 comprising the compression spring 74′ and the insert 70′ with associated elements which are the same in structure and operation as the corresponding elements of the intake valve 60. Accordingly, they have been given the same reference numerals with a prime symbol added. The orientation of the release valve 90 and its component parts is upside down relative to the intake valve 60.

The upper end of the insert 70′ is shown threaded to engage a release valve actuator 95 (FIG. 6). Other means of attachment may be used. It will be understood that the upper end of the insert 70′ projects above the upper end of the valve 90 (FIG. 1) by a sufficient extent that the actuator 95, when threaded onto the insert 70′, has a certain clearance with respect to the upper end of the valve 90. This clearance permits the actuator 95 and insert 70′ to be pushed downwardly, when it is desired to release the liquid contents of the upper chamber 30 in a spray, fog or stream, to the point where the O-ring 72′ against the slanted surface 76′ clears the openings 86′ and permits liquid to flow through the openings 86′ and upwardly through the bore 84′.

Figure 7:
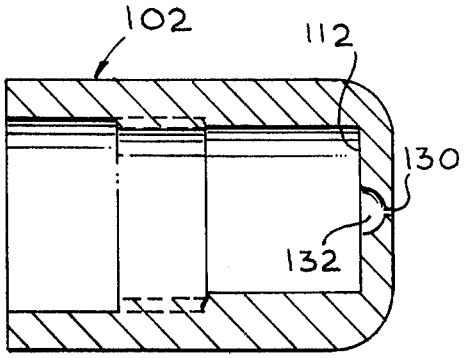
FIG. 7 is a side view in section of the outlet nozzle of the variation of FIG. 1.
Figure 9:
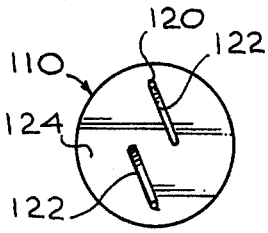
FIG. 9 is an end view of the deflector element of FIG. 8.
Figure 8:
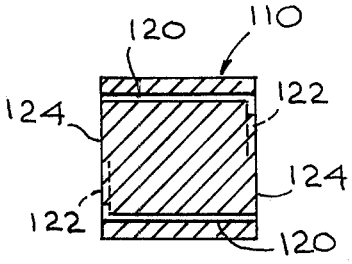
FIG. 8 is a side view of the deflector element of the variation of FIG. 1.

The actuator 95 contains a bore 96 at right angles to the bore 84′ and communicating therewith in assembly. The actuator 95 further includes a threaded outlet portion 98 and an O-ring 99 mounted in a recess 100 for sealing engagement with a nozzle 102 (FIG. 7). The actuator 95 is further configured with a concave curved portion 104 which is shaped to fit a user's finger and is intended to be the point at which downward pressure is exerted by the user's index finger in actuating the release valve 90. The bore 96 of the actuator 95 is enlarged in a cone-shaped section 106 at the outlet end thereof (the right-hand end as shown in FIG. 6). When the nozzle 102 of FIG. 7 is threaded onto the actuator 95 so that the entire unit may be used as a sprayer, a deflector 110 (FIGS. 8 and 9) is positioned within the nozzle 102 bearing against the right-hand interior wall 112 of the nozzle 102 and also bearing against the right-hand surface 114 of the actuator 95. The deflector 110 is provided with a pair of longitudinal openings 120 which communicate with open grooves 122 in the opposed faces 124 of the deflector 110. These grooves 122 extend inwardly but non-radially from the openings 120 and terminate at predetermined points near the center of the face 124. A single opening 120 with associate groove 122 may suffice or more than two may be used, if desired.

When the nozzle 102 with the deflector 110 therein is mounted on the actuator 95, the right-hand face 124 of the deflector 110 bears tightly against the interior surface 112 of the nozzle 102 which serves to close the grooves 122 along the outer portions thereof. The nozzle 102 is provided with a release opening 130 extending outwardly from an enlarged recess 132 in the interior face 112. With the deflector 110 in position within the nozzle 102, the face 124 combines with the recess 132 to form a turbulence chamber. Liquid released when the actuator 95 is depressed is introduced via the grooves 122 into the recess 132 with a rotating or cyclonic motion. By virtue of the configuration of the turbulence chamber established by the recess 132 and the very short extent of the opening 130, this cyclonic motion is continued as the liquid is propelled outwardly from the nozzle 102. As it leaves the opening 130, the centrifugal force developed by the cyclonic action of the liquid breaks up the liquid stream into a fine spray, fog or mist, effectively matching the spray which is achieved by the use of an operative aerosol type sprayer. The characteristics of the spray emitted from the nozzle 102 can be varied by changing the orientation of the grooves 122, the size of the openings 120 and grooves 122, and by varying other dimensions of the structure involved in relation to the viscosity of the liquid being sprayed. The grooves 122 on opposite faces 124 of the deflector 110 may be arranged differently so that some variation in the spray may be achieved simply by reversing the orientation of the deflector 110 in the nozzle 102. If the deflector 110 is removed from the nozzle 102, the unit projects a very fine but far-reaching jet of liquid through the opening 130. The projection of such a stream is sometimes desirable as, for example, when it is desired to be able to direct an insecticide into the upper reaches of a tree or to apply a fire extinguisher to the base of a small fire. This feature of optional utilization achieves a versatility for arrangements in accordance with the present invention which is not realized by any of the conventional aerosols, insofar as is known to this inventor.

It will be appreciated that one of the significant advantages of arrangements in accordance with the present invention derives from the fact that the device is refillable and thus reusable. This is accomplished by first releasing the pressure in the lower chamber 32 by pressing inwardly on the insert 70 of the intake valve 60. Thereafter, the cover 50 is unscrewed from the body portion 24 and the unit is cleaned as necessary. To fill the upper chamber 30 with liquid, the piston 34 is pushed downwardly by one's finger or a pencil or any similar implement until it seats against the piston ledge 36. Thereafter the liquid is poured into the upper chamber 30, preferably until the chamber 30 is entirely filled. The cover 50 is then replaced with the seal between cover 50 and body portion 24 reestablished by pressure upon the O-ring 54. Thereafter the lower chamber 32 is pressurized, preferably by admitting air through the intake valve 60 to a pressure of approximately 150–200 psi and the unit is ready for use. There is no waste, since the container itself is reusable and need not be discarded when empty. The propellant in the lower chamber 32 is harmless anyway, preferably being air, but it is not released with the liquid from the upper chamber 30 as the latter is sprayed during use of the unit. The unit is refillable from bulk containers, thus realizing a significant economy in the purchase of the liquids which are to be used in spray units of the present invention. The unit need not be completely exhausted before it is refilled; accordingly, one need not begin an extended period of use of the unit with only a partially filled upper chamber 30 but instead may prepare for such by releasing the air from the lower chamber 32 and refilling the upper chamber 30 completely, even though it was only partially empty to begin with. If desired, the unit may be disassembled, as described for refilling, and the contents of the upper chamber 30 may be removed therefrom so that the unit, after cleaning, may be filled with some other liquid which is desired to be sprayed at the moment.

Since the spray unit of my invention is designed with aspects of economy, effectiveness and efficiency in mind, I have also devised a compressor unit which is to be incorporated with the spray unit, above described, as a system. Such a system 200 including a compressor unit 202 is shown in FIG. 10 with a sprayer 20 in phantom outline thereon as it would be mounted for pressurizing by the compressor 202 in the system 200.

The compressor 202 utilizes a small electric motor 204 (see FIG. 13) mounted on a base 206 having feet 208. A timer switch 210 and line cord 212 are provided to energize the motor 204.

Figure 10:
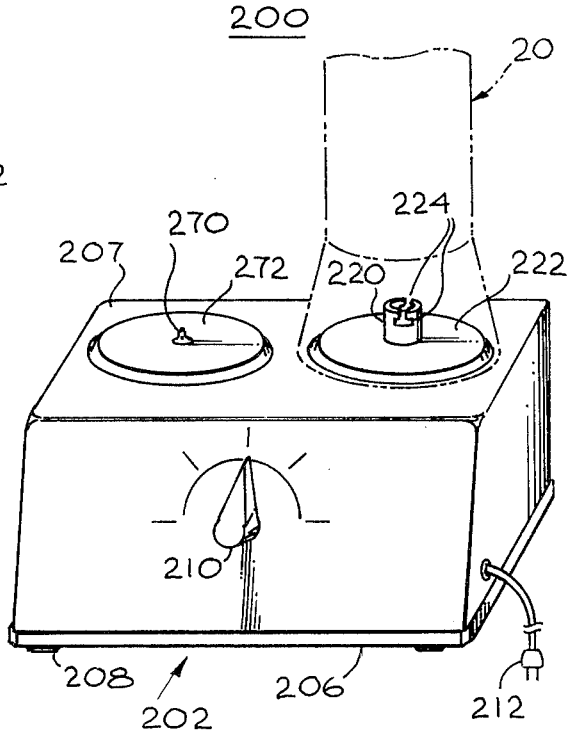
FIG. 10 is a perspective view of a compressor in accordance with the present invention for pressurizing the sprayer of FIG. 1.

As shown in FIG. 10, a cylinder 220 is shown extending upwardly from a cover 207 in the center of a raised pedestal 222. The arrangement of the cylinder 220 and the pedestal 222 are such that the valve 60 is inserted into the cylinder 220 when the base portion 26 of the unit 20 is positioned to engage the sides of the pedestal 222. The upper end of the cylinder 220 is shaped to define lug receiving recesses 224. These recesses 224 receive the lugs or dogs 62 of the valve 60 which are then locked in the recesses 224 by slightly twisting the unit 20 in position on the pedestal 222.

Figure 11:
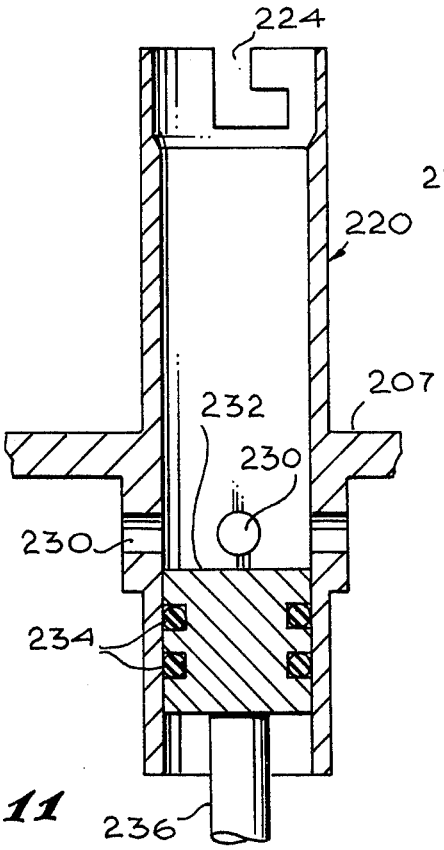
FIG. 11 is a sectional view of one particular arrangement of the cylinder of the compressor of FIG. 10.

When the valve 60 is inserted into the cylinder 220, the O-ring 66 of the valve 60 bears in sealing relationship against the interior wall of the cylinder 220 with the unit 20 locked in position on the cylinder 220. When in such position, the valve 60 closes the open upper end of the cylinder 220 and serves as the exhaust valve for the cylinder 220. As shown in FIG. 11, which is an enlarged sectional view of the cylinder 220, intake ports 230 are provided in the sides of the cylinder 220 and are cleared by the piston 232 when it reaches the lower end of its stroke. The piston 232 is provided with suitable sealing members 234, shown as O-rings, and a connecting rod 236 for driving the piston 232 up and down in the cylinder 220. The volumetric displacement of the cylinder 220 is such that the piston develops a pressure in the selected range of 150–200 psi by the time it reaches its top dead center point with the spray unit in place with the valve 60 locked to the upper end of the cylinder 220. Thus, even if the compressor is left running indefinitely, it cannot exceed this predetermined pressure which is selected as the maximum pressure for the lower chamber 32 of the spray unit 20. In operation of the compressor 202 in the system 200, however, the motor 204 is energized only for a predetermined limited time by setting the timer switch 210 to a selected position. Thereafter, the compressor 202 operates until the timer switch 210 turns off, by which time the associated spray unit 20 is pressurized to the desired level. Where a single compressor 220 is to be used with different spray units 20 of varying volumetric capacities, the dial of the timer switch 210 may be marked for the settings corresponding to the different sizes of spray units.

In the operation of the piston and cylinder arrangement of FIG. 11, the valve 60 is inserted within the upper end of the cylinder 220 so that the O-ring 66 slides into sealing engagement with the interior wall of the cylinder 220. As the piston 232 moves up and down, air enters the cylinder 220 through the ports 230 as the ports are cleared by the piston 232 at the bottom of its stroke. As it moves upward past the ports 230, the ports are sealed off and the air inside the cylinder 220 is compressed and forced out through the intake valve 60 at the top of the cylinder 220 which serves as the exhaust valve for the cylinder. On the return stroke, the valve 60 closes, and a vacuum is developed within the cylinder 220 until it is relieved by the opening of the ports 230 as the piston 232 clears these ports.

Figure 12:
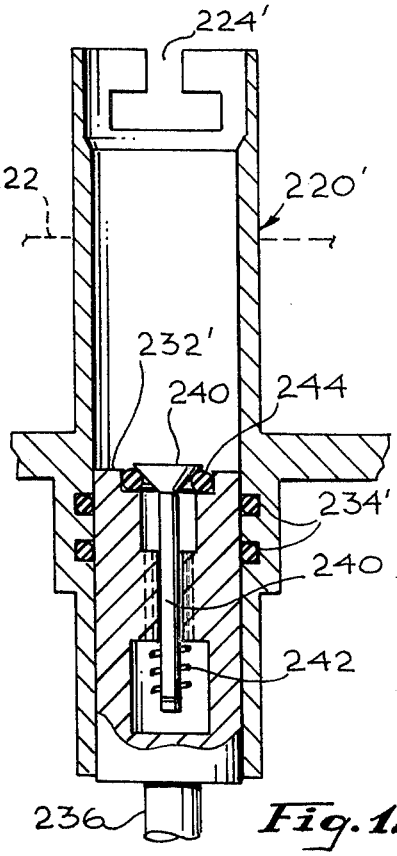
FIG. 12 is a sectional view of an alternative arrangement of the cylinder of the compressor of FIG. 10.

An alternative arrangement of a cylinder and piston is shown in FIG. 12. Here a cylinder 220' is shown having a pair of O-rings 234' mounted in grooves within the cylinder. A bayonet type locking arrangement 224' is provided for engaging the lugs 62 of the valve 60 of an associated spray unit 20. The piston 232' is hollow and contains an integral intake valve 240 mounted therein and biased by a spring 242 in sealing relationship with an O-ring 244. As the piston 232' moves upwardly, the valve 240 closes so that the air in the cylinder 220' is compressed and forced outwardly through the intake valve 60 of the associated spray unit 20. On the down stroke of the piston 232', the valve 240 lifts from its position against the O-ring 244 and permits air to enter the cylinder 220' through the hollow piston 232'. On the upstroke, the valve 240 again seals against the O-ring 244 and the air in the cylinder 200' is compressed as the cycle is repeated.

Figure 13:
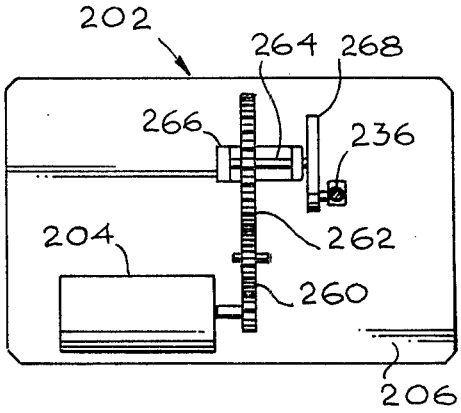
FIG. 13 is a plan view in partial section of the compressor of FIG. 10 with the cover removed.

FIG. 13, which is a plan view of the compressor 202 with the cover 207 removed, illustrates the drive arrangement between the electric motor 204 and the piston connecting rod such as 236. As shown, the motor 204 is connected through reduction gears 260, 262, a shaft 264 mounted in a support bracket 266 affixed to the base 206, and an eccentric wheel 268 to which the lower end of the connecting rod 236 is attached for rotation therewith. Thus, in simple fashion, the rotary motion of the shaft of the motor 204 is converted to the reciprocating linear motion of the rod 236 which drives the associated piston such as 232 in the cylinder 220.

In operation, as previously mentioned, the pressure in the lower chamber 32 of the spray unit 20 is released in preparation for filling and charging the unit 20. To facilitate release of the pressure from the chamber 32, a projection 270 is positioned on top of a pedestal 272 on the upper face of the housing 207 (FIG. 10). The element 270 is dimensioned to engage the insert 70 of the intake valve 60 when the unit 20 is placed thereon, centered by the edges of the pedestal 272. The element 270 may be provided with apertures for permitting the release of air as the intake valve 60 is opened. With the unit 20 in this position, the piston 34 within the unit 20 is pushed to its bottom position against the piston ledge 36 (FIG. 1). Thereafter the upper chamber 30 may be filled with the liquid to be dispensed and the cover 50 affixed in place as already described. Next the unit 20 is transferred to the pedestal 222 and rotated to engage the locking mechanism of the lugs 62 in the recesses 224. The timer switch 210 is now set to charge the lower chamber 32 to the desired pressure and the compressor 202 is permitted to run for the predetermined time. Thereafter the unit 20 is ready to use and may be removed from the compressor 202. There have thus been described various aspects of a sprayer and compressor system which are admirably adapted for the purpose intended. Spray units in accordance with the present invention avoid despoiling the environment, both by virtue of the fact that the propellant used is simply air which is not discharged into the atmosphere during use and because the containers of the spray units can be reused repeatedly rather than having to be discarded as garbage or litter when exhausted. The spray units are superior to aerosols presently available in many ways, but one particular advantage is their capability of operating effectively in any attitude, upside-down or otherwise. In addition to their use as spray units, devices in accordance with the present invention may also be used for other purposes, such as for example the dispensing of certain liquid food products. By suitable dimensioning of the openings in the bore 84' of the release valve 70', the bore 96 of the actuator 95 and the opening 130 of the nozzle 102 (omitting the deflector 110) the unit 20 may be used to dispense items such as mustard or catsup at a rate of flow and with a final release pressure which are entirely compatible with the normal usage of such products. However, use of the device of this invention in such a fashion would be greatly superior to other known dispensers, since it would virtually eliminate waste and mess, would maintain the contents sealed from the atmosphere under positive internal pressure and would provide a far better application of the food product.

Although there have been described above specific arrangements of an airless sprayer and pressurizing system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A self-contained dispensing unit for dispensing liquid contents under pressure comprising:

a container;

a free-floating piston dividing the container into a first chamber for storing liquid to be dispensed and a second chamber for containing a pressurized gas; and a manually operable liquid release valve communicating with the first chamber for controllably releasing liquid therefrom under pressure from the second chamber, the valve comprising a valve body with a cylindrical bore having a projecting interior ledge for engaging a resilient sealing member, an insert member receivable through the bore of the valve member and having a cylindrical section of reduced diameter defining an outwardly projecting ledge for engaging a resilient sealing member, the insert member further having an axial bore extending within the cylindrical section and terminating adjacent the outwardly projecting ledge and at least one radial opening extending from the axial bore to outside the cylindrical section, a resilient sealing member mountable on the insert member to seal the cylindrical section to the cylindrical bore of the valve body upon assembly and to releasably seal the radial opening upon engagement between said ledges, and a biasing spring for urging the insert member ledge toward the projecting interior ledge of the cylindrical bore to compress the resilient sealing member therebetween.

2. The device of claim 1 wherein said radial opening and said axial bore provide a path for the free passage of liquid past the sealing member when the insert is moved against the force of the biasing spring to a position in which the sealing member is not in sealing relationship across the radial opening.

3. The device of claim 1 wherein the axial bore and radial opening comprise a first liquid passage and wherein the manually operable valve further includes exit nozzle means defining a second liquid passage, the ratio of sizes of said first and second passages being selected to control the flow characteristics of the released liquid.

4. The device of claim 3 wherein the nozzle means includes means for alternatively dispensing said liquid as a jet or a spray.

5. The device of claim 3 wherein the nozzle means comprises means defining a turbulence chamber with an exit opening adjacent thereto and means for introducing the pressurized liquid to the chamber with a rotational motion so that the liquid is dispensed through the exit opening in a fine spray.

6. The device of claim 5 wherein the last-mentioned means includes a deflector member having at least one passage for the liquid extending therethrough and terminating in a non-radially-directed section opening into the turbulence chamber.

7. The device of claim 5 wherein the last-mentioned means includes a deflector member having a pair of diametrically opposed longitudinal passages extending between opposite faces of the member and a pair of recesses along the downstream face, each extending non-radially from a corresponding passage to a corresponding outlet near but offset from the axis of the deflector member, said outlets being diametrically opposite each other and communicating with the turbulence chamber.

8. The device of claim 7 wherein the nozzle means includes a mating surface bearing against the downstream face of the deflector member and closing said recesses except in the region of the turbulence chamber.

9. The device of claim 8 wherein the deflector member has recesses along both opposed faces and is reversible in direction of mounting within the nozzle means, the recesses of opposite faces being differently configured to accommodate liquids of different flow characteristics.

10. The device of claim 5 wherein the longitudinal extent of the means defining the exit opening is selected to induce a dispersion of the liquid into a fine spray as it exits from the turbulence chamber.

11. The device of claim 1 wherein the container includes a cover closing the first chamber and mounting the release valve thereon, said cover being removable from the container to permit refilling of the first chamber.

12. The device of claim 11 further including matching threaded retaining means in the cover and the container for releasably mounting the cover to the container.

13. The device of claim 12 further including second sealing means positioned to seal the cover to the container when the cover is mounted to the container.

14. A self-contained dispensing unit for dispensing liquid contents under pressure comprising:

a container;

a free-floating piston dividing the container into a first chamber for storing liquid to be dispensed and a second chamber for containing a pressurized gas;

a release valve communicating with the first chamber for controllably releasing liquid therefrom under pressure from the second chamber; and a pneumatic intake valve communicating with the second chamber for admitting gas under pressure to the second chamber, the intake valve comprising a valve body with a cylindrical bore having a projecting interior ledge for engaging a resilient sealing member, an insert member receivable through the bore of the valve member and having a cylindrical section of reduced diameter defining an outwardly projecting ledge for engaging a resilient sealing member, the insert member further having an axial bore extending within the cylindrical section and terminating adjacent the outwardly projecting ledge and at least one radial opening extending from the axial bore to outside the cylindrical section, a resilient sealing member mountable on the insert member to seal the cylindrical section to the cylindrical bore of the valve body upon assembly and to releasably seal the radial opening upon engagement between said ledges while retaining the insert member against removal from the valve body, and means for urging the insert member ledge toward the projecting interior ledge of the bore to compress the resilient sealing member therebetween.

15. The device of claim 14 wherein the urging means comprises a biasing spring compressed between opposing faces of the valve body bore and the insert member.

16. The device of claim 15 wherein said radial opening and said axial bore provide a path for the free passage of gas past the sealing member when the insert is moved against the force of the biasing spring to a position in which the sealing member is not compressed.

* * * * *